US008795105B2

(12) United States Patent
Noonan

(10) Patent No.: US 8,795,105 B2
(45) Date of Patent: Aug. 5, 2014

(54) APPARATUS AND METHODS FOR RETAINING TENNIS BALLS HIT INTO TENNIS NETS

(71) Applicant: Mark Noonan, New Canaan, CT (US)

(72) Inventor: Mark Noonan, New Canaan, CT (US)

(73) Assignee: Nootools II, LLC, New Canaan, CT (US)

( * ) Notice: Subject to any disclaimer, the term of this patent is extended or adjusted under 35 U.S.C. 154(b) by 0 days.

(21) Appl. No.: 14/060,067

(22) Filed: Oct. 22, 2013

(65) Prior Publication Data

US 2014/0121044 A1 May 1, 2014

Related U.S. Application Data

(60) Provisional application No. 61/795,856, filed on Oct. 26, 2012.

(51) Int. Cl.
*A63B 47/02* (2006.01)

(52) U.S. Cl.
CPC ..... *A63B 47/02* (2013.01)
USPC ..... 473/460

(58) Field of Classification Search
USPC ..... 473/490, 494, 460
See application file for complete search history.

(56) References Cited

U.S. PATENT DOCUMENTS

| | | | | |
|---|---|---|---|---|
| 2,615,715 | A * | 10/1952 | Moore | 473/495 |
| 4,568,089 | A | 2/1986 | Jenkins et al. | |
| 4,886,268 | A * | 12/1989 | Langslet | 473/492 |
| 4,919,421 | A | 4/1990 | Vandeveld | |
| 4,997,185 | A | 3/1991 | Bartasius | |
| 5,141,226 | A * | 8/1992 | Cavanagh | 473/460 |
| 6,277,039 | B1 * | 8/2001 | Kleinschrodt | 473/460 |
| 6,758,770 | B2 * | 7/2004 | Chandronnait | 473/494 |
| 8,435,141 | B2 * | 5/2013 | Harris et al. | 473/460 |
| 2003/0073519 | A1 * | 4/2003 | Shau | 473/460 |
| 2004/0110579 | A1 * | 6/2004 | Chandronnait | 473/490 |
| 2012/0322589 | A1 * | 12/2012 | Harris et al. | 473/460 |
| 2014/0121044 | A1 * | 5/2014 | Noonan | 473/460 |

* cited by examiner

*Primary Examiner* — Raleigh W Chiu
(74) *Attorney, Agent, or Firm* — Harness, Dickey & Pierce, P.L.C.

(57) ABSTRACT

According to various aspects, exemplary embodiments are disclosed of apparatus and methods for retaining (e.g., controlling, funneling, redirecting, gathering, and/or capturing, etc.) tennis balls hit into tennis nets, to inhibit or prevent the tennis balls from bouncing off or rolling away from a tennis net back onto the main playing surface of a tennis court.

20 Claims, 7 Drawing Sheets

APPARATUS AND METHODS FOR RETAINING TENNIS BALLS HIT INTO TENNIS NETS

CROSS-REFERENCE TO RELATED APPLICATION

This application claims the benefit and priority of U.S. Provisional Application No. 61/795,856 filed Oct. 26, 2012. The entire disclosure of the above application is incorporated herein by reference.

FIELD

The present disclosure generally relates to apparatus and methods for retaining (e.g., controlling, funneling, redirecting, gathering, and/or capturing, etc.) tennis balls hit into tennis nets.

BACKGROUND

This section provides background information related to the present disclosure which is not necessarily prior art.

Tennis nets are generally designed to stop a ball. But conventional tennis nets are not specifically designed to control where a ball will travel or come to rest after hitting the net. Accordingly, a ball that hits a tennis net will oftentimes bounce or roll back onto the main playing surface of a tennis court, where the ball may then interfere with the game play or practice drills and/or possibly cause an ankle or foot injury.

SUMMARY

This section provides a general summary of the disclosure, and is not a comprehensive disclosure of its full scope or all of its features.

According to various aspects, exemplary embodiments are disclosed of apparatus and methods for retaining (e.g., controlling, funneling, redirecting, gathering, and/or capturing, etc.) tennis balls hit into tennis nets, to inhibit or prevent the tennis balls from bouncing off or rolling away from a tennis net back onto the main playing surface of a tennis court.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
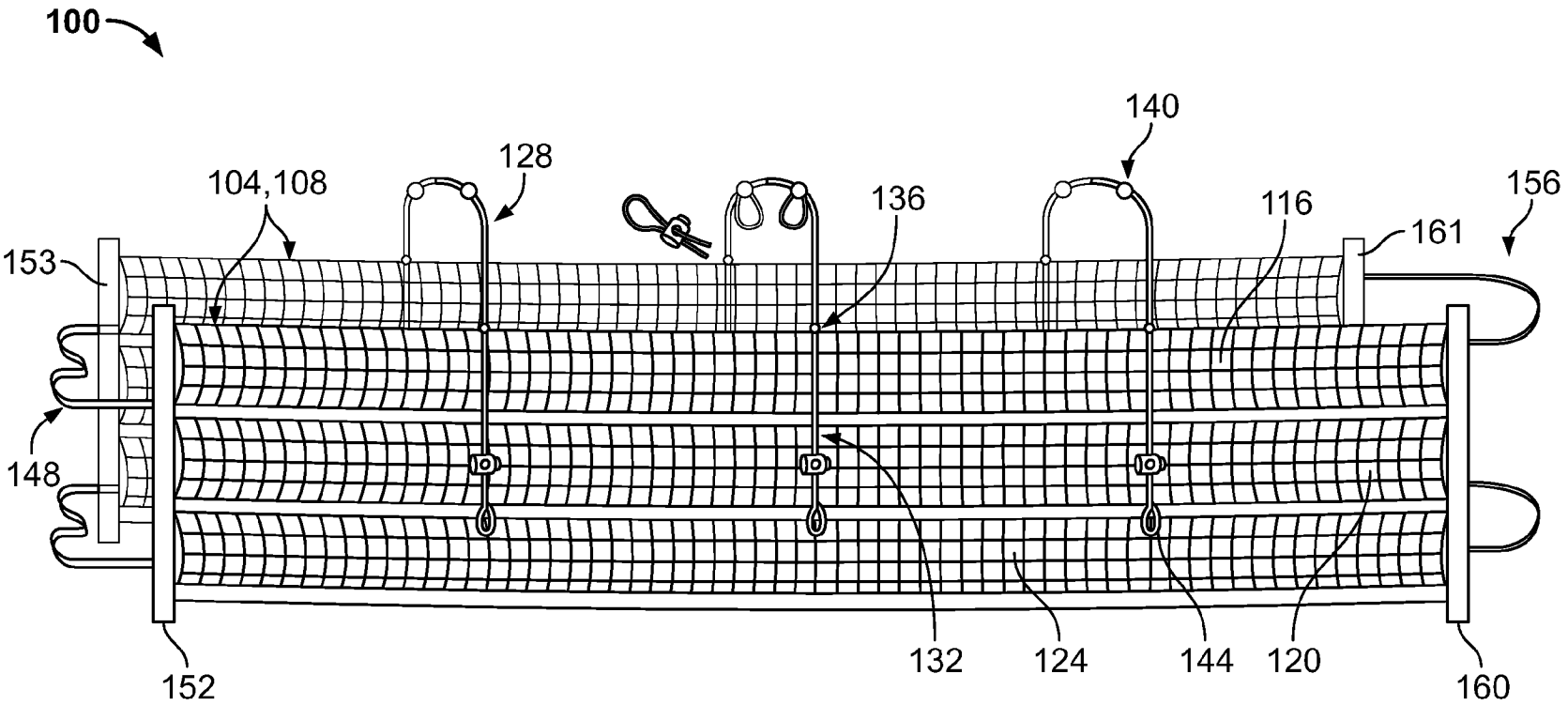
FIG. 1 illustrates a tennis net apparatus according to an exemplary embodiment.
Figure 4:
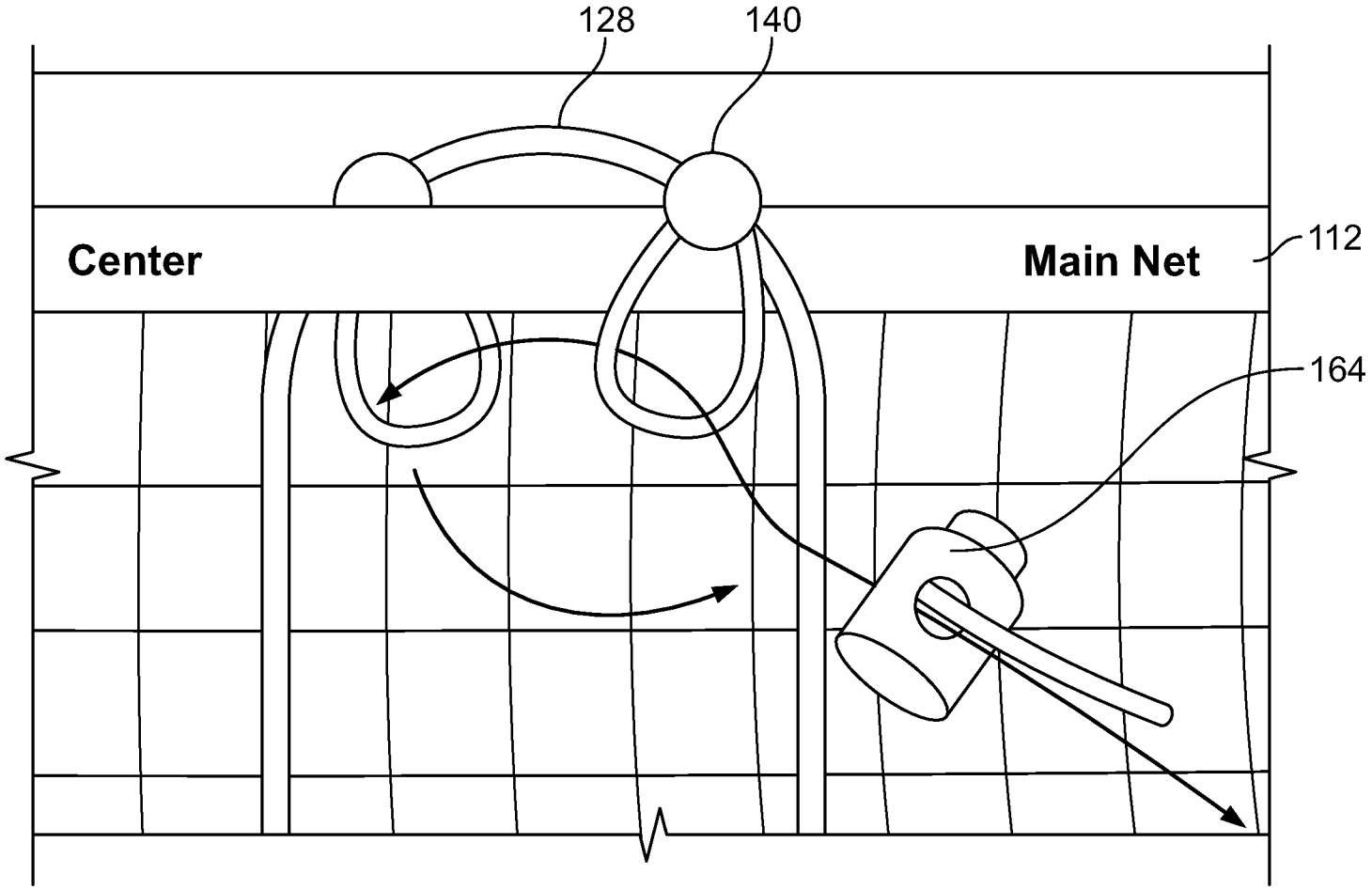
Figure 5:
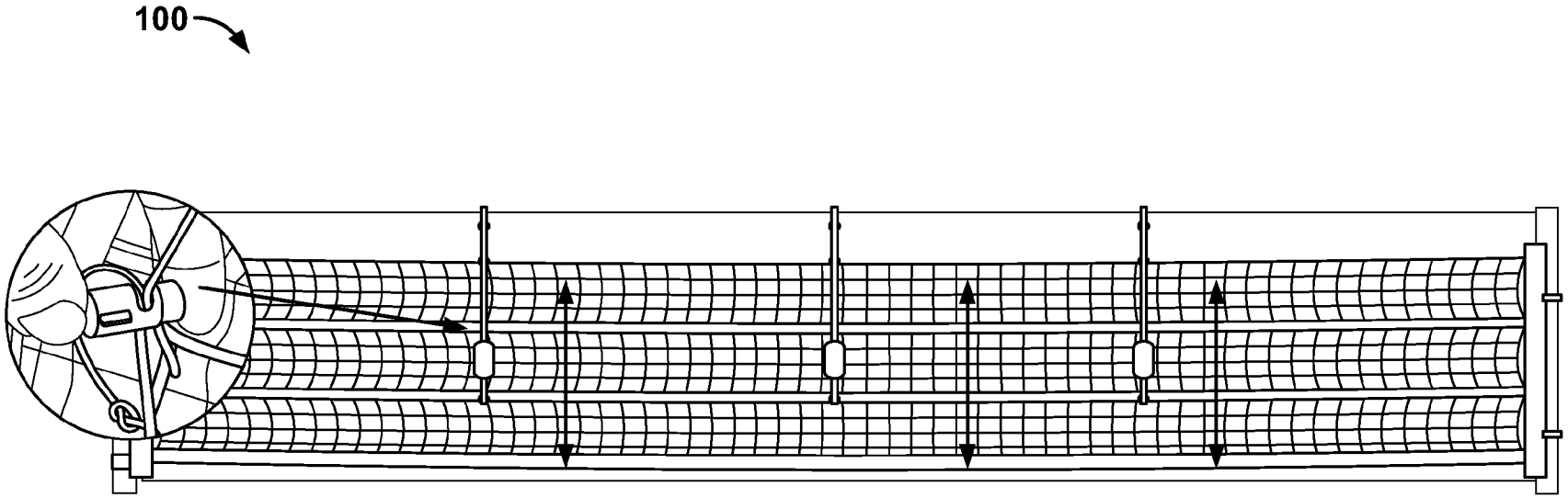
Figure 6:
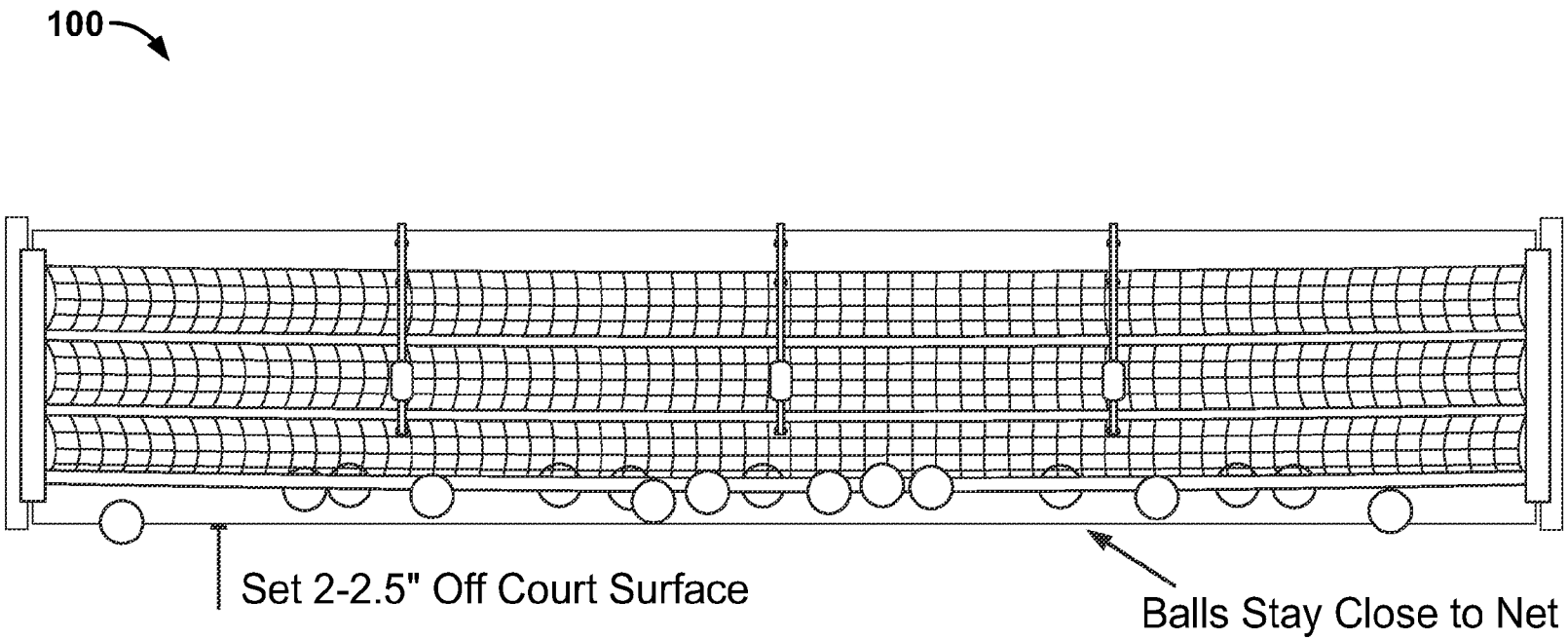
Figure 7:
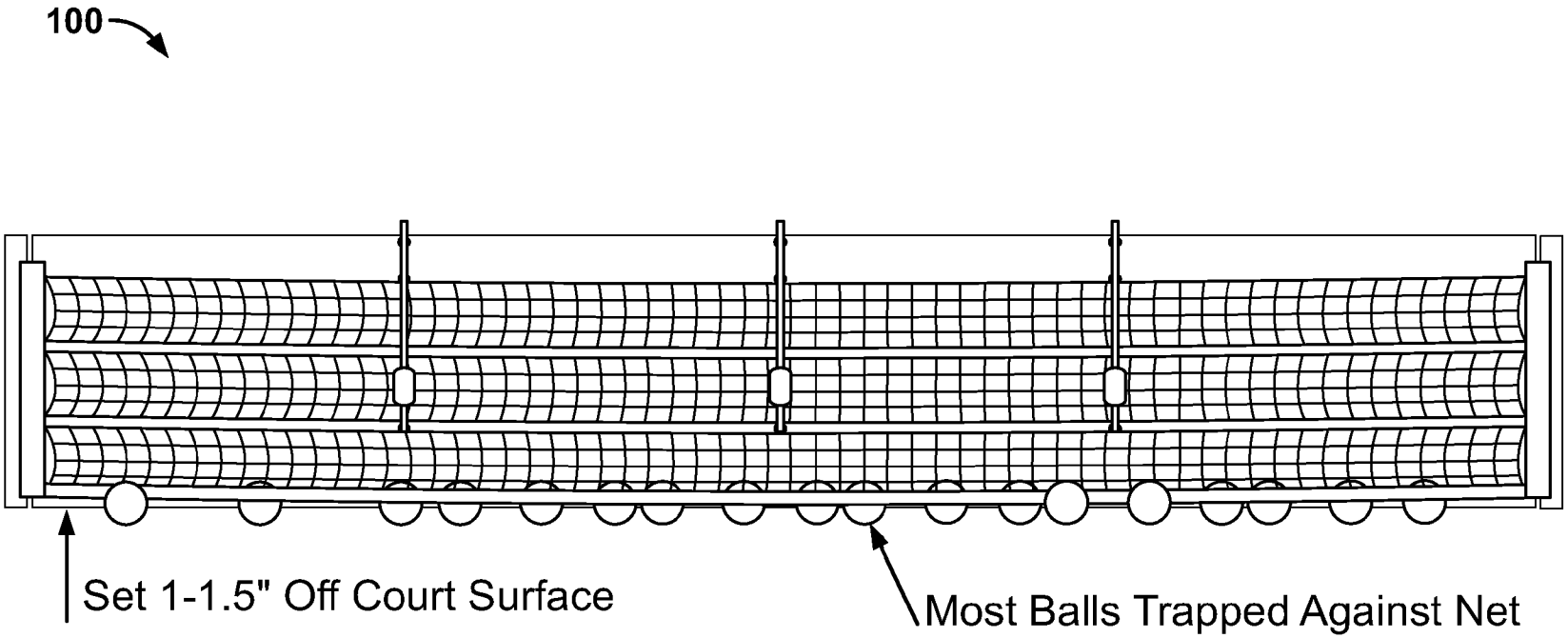

FIG. 4 illustrates the exemplary manner by which a tether of the tennis apparatus may be coupled to the main tennis net using a cinching device according to exemplary embodiments; and FIGS. 5 through 7 illustrates the tennis net apparatus shown in FIG. 1 and exemplary manner by which cord lock tensioners along a top edge of the bottom net or layer of netting may be used to adjust the bottom net and change the distance separating the court surface and bottom net.

Corresponding reference numerals indicate corresponding parts throughout the several views of the drawings.

DETAILED DESCRIPTION

Example embodiments will now be described more fully with reference to the accompanying drawings.

Tennis balls that hit the net more often than not tend to accumulate close or nearer to the net. But tennis balls may also roll back onto and disperse into the main playing areas of the tennis court, where they will interfere with play or possibly be stepped on by a player. During drills and lessons, tennis balls bouncing off the net back into the court often require stoppages to clear unsafe balls from the court and/or cause player distractions. During match play, for example, a tennis ball served into the net will often roll back onto the main playing surface of the court, thereby requiring the server to clear or pick up the ball prior to continuing play.

After recognizing the above, the inventor hereof has developed and discloses herein exemplary embodiments of tennis net adapters or apparatus configured or designed to alleviate the aforementioned problems. For example, an exemplary embodiment disclosed herein may help reduce the risk of a player stepping on a ball, avoid play/drill stoppages to remove stray balls, avoid a ball-in-play hitting another stray ball on the court, speed up match play, and/or provide for faster or simpler ball collection.

According to exemplary aspects of the present disclosure, exemplary embodiments of an apparatus or device are disclosed, which are configured to be installed onto or over a tennis net or integrated or built into the tennis net. In either case, the installed or integrated apparatus adapts or modifies the tennis net and controls the deflection of tennis balls hit into the net. The apparatus redirects and/or funnels the tennis balls hitting the net to collect mostly on the court surface at or near the base of the net. For example, a majority of the tennis balls hitting the modified net may collect or come to rest at or near the bottom of the net, e.g., where the bottom of the net meets or touches the court surface or comes close to the court surface if the net does not actually reach or touch the court surface. Also disclosed are methods for controlling the deflection of tennis balls hit into a net, such that the tennis balls collect on the court at or near the bottom of the net.

In an exemplary embodiment, an apparatus or device comprises first and second arrays. Each array includes several generally parallel and partially overlapping net sections or courses. The two arrays may be installed or retrofit simultaneously in tandem on or along opposite sides of a tennis net. Accordingly, the first array may be adjacent and overlaying a first side of the tennis net. The second array may be adjacent and overlaying the second side of the tennis net, which is opposite the first side. The arrays are configured to substantially or largely cover most of the tennis net surface and are substantially flat or flush when installed. In operation, the apparatus captures tennis balls hit into the tennis net adapter arrays by allowing the balls to pass over, through, or thereunder. The balls are slowed and/or deflected by the apparatus until coming to rest on the tennis court surface adjacent or at the base of the net, instead of being spread more randomly across the tennis court. The apparatus also captures and controls balls hit into the tennis net in the space above the net adapter arrays. Accordingly, the apparatus is thus operable for controlling netted balls so that they come to rest at or close to the base of the net. Advantageously, the apparatus may thus increase safety by reducing risk of injury that might otherwise occur when tripping or stepping on an errant tennis ball laying in the court. The apparatus may also advantageously provide more convenient play and time savings cleaning up tennis balls that might otherwise roll into the more used area of the court for play.

Exemplary embodiments disclosed herein may be associated with one or more (but not necessarily any or all) of the following features and/or advantages. For example, the apparatus may be configured to install nearly fully flat or flush against the main tennis net so as to be largely two-dimensional such that it does not interfere with play, players, or net cord balls dribbling over the net. The apparatus may be configured so that it does not meaningfully obstruct visibility and/or may be installed and removed quickly and easily on most tennis nets and posts (e.g., via a single person in minutes, etc.). The apparatus may be configured such that it does not add significant extra tension to existing tennis net posts and/or has no meaningful material running over the top of the tennis net (e.g., zero or about zero, etc.). The apparatus may be configured with the ability to redirect and capture/contain most balls hit into the tennis net down onto the court surface for ball pickup/cleanups. The apparatus may be configured such that it can be left in place such that balls may be picked up without having to move or reset the device in any way. The apparatus may be configured to redirect or funnel tennis balls without providing the main slowing or stopping forces on the tennis balls, which is instead provided by the main tennis net. The apparatus may be configured such that it is usable or adaptable to nearly any tennis net as well. Or, the apparatus may be integrated or built into or around a standard tennis net, which would then be installed together. The apparatus may be configured such that the adapter net parallels the main tennis net, including generally following the tapering shape of the tennis net, e.g., narrower or shorter in the center versus wider or higher at the end posts. The apparatus may thus provide users with the means for directing and funneling tennis balls by slowing, redirecting, or catching them in one or more of the adapter net structures arrayed over at least a majority or most of the primary or main tennis net surface.

An exemplary embodiment utilizes first and second arrays of overlapping nets which is each shorter than the main tennis net. The arrays are wide or almost as wide as the main net. The first and second arrays cover most, but not necessarily all, of the main tennis net surface. A tennis ball will pass through gaps or seams between adjacent pairs of the nets in an array. Then, the tennis ball will generally impact the main tennis net as they pass over or push back one of the smaller nets of an array before the ball is slowed and/or directed downward. Generally, a tennis ball will be funneled between the main tennis net and the corresponding first or second array of nets depending on which side of the court and main tennis net the ball is on. The ball will ultimately come to rest on the ground or court surface after being slowed by the impacts with one or both the main tennis net and the array of nets. The bottommost nets in the first and second arrays may be set low enough (e.g., FIG. 6, etc.) such that balls exiting from the bottom of the first and second arrays will be further slowed or stopped. If desired, the bottommost nets of the arrays may be set to a low enough height (e.g., FIG. 7, etc.) to mostly trap balls between the main net and the first and second arrays of nets.

An exemplary embodiment of the net adapter or apparatus comprises first and second arrays of nets that are about as wide as the main tennis net. But each net by itself may be significantly shorter than the 36 inch to 42 inch height of the main tennis net. The nets are attached to end posts (e.g., FIG. 1, etc.) at each end to thereby form the first and second arrays of overlapping nets (e.g., FIG. 2, etc.). The first and second arrays of overlapping nets are installed along or on a front of each side of an existing main tennis net. The individual nets (and the arrays) are fixed and set largely flat and in a mostly vertical array but with some overlap (e.g., similar to the overlapping configuration of window blinds, etc.) In an exemplary embodiment, the apparatus may include 3 or 4 net sections (or separate nets) that define each array—one array on each side of the main tennis net.

The first and second arrays of nets are intended to lay nearly fully flat against the main tennis net when at rest (prior to ball impact) and cover most of the width, but not necessarily the full height, of the main tennis net. Though the nets partially overlap on another, a tennis ball striking nearly anywhere on the net array will push the corresponding net section or portion of the array backwards, which, in turn, will open a gap between that net section and the rest of the arrayed nets below the impact. The gap allows the ball to pass through the gap and enter into the area, cavity, or space formed between the net array and the main tennis net. The array funnels the ball between the main tennis net and the array before the ball drains onto the tennis court surface (e.g., FIG. 3, etc.).

By way of example only, the top net in each array might be set as much as 8 to 10 inches below the top of the main tennis net cord. This setting may then permit a tennis ball that passes above the array to hit near the top portion of the main tennis net (including hitting the net cord or tape) where the ball tends to mostly rebound with a downward component. The ball would still be funneled behind the adapter nets within the space between the adapter nets and the main tennis net. The specific dimensions disclosed in this paragraph and any other dimensions disclosed herein are example in nature and do not limit the scope of the present disclosure.

The adapter nets may be set in the arrays such that they largely follow or parallel the top cord or tape of the main tennis net. The height of the adapter net arrays and the individual nets within each array may be kept in place to maintain their relative position within the array and relative to the main tennis net (and the shape of the array) both at rest and during impact.

In an exemplary embodiment, one or more of the adapter nets (e.g., the lower or bottommost net, etc.) may be configured or cut (e.g., double 'V' shape, double-tapered edge, hourglass shape, etc.) such that the net is narrower at its center and wider at its outer edges or ends. This shape roughly mirrors the difference in height of the main tennis net, which, by specifications is 6 inches lower in the center than at the sides and posts. Shaping one or more of nets in this manner may advantageously create relatively even or uniform spacing between each net course across the full width of the main tennis net. The "hourglass" shape may be used for any or all of the nets in an array. But using the "hourglass" shape for at least the lowest or bottom net improves performance modestly because it results in having the widest net height on the array where there are no gaps or overlap at the bottom outer corners of the array and main tennis net, which coincides with the locations at which tennis balls are least likely to be hit and even less likely to roll back into the court. Alternative embodiments may include one or more nets shaped differently, e.g., rectangular shaped nets, etc.

The adapter net apparatus includes thin vertical strands or tethers (e.g., FIG. 1, etc.) that connect to each of the individual nets to help maintain their positions relative to the main tennis net and to one another. The tethers run over or through the main tennis net. The tethers may include knots or loops to function as guides to confirm that the adapter nets are centered and set properly, to potentially provide means to cinch the adapter nets, and means to anchor to the main tennis net top cord or tape to thereby reduce chances of the adapter net arrays being pulled or shifting out of position and becoming off-centered.

The tethers also help support the arrays of nets as the arrays to some degree hang from the tethers. The tethers may pass over the top of the main tennis net. In an alternative embodiment, the tethers may pass through the tennis net. A connector may be provided near the center of the tether, which connector allows the tether to be detached and reattached (e.g., below the net cord or tape, etc.) for installation and removal.

The end posts and tethers also help ensure the individual net courses or sections of the arrays maintain their relative position and heights. When installed, the end posts generally rest on the court surface and top and bottom cords that may be strung through the net courses or sections.

In an exemplary embodiment, there is one cord through or along the top of each net course or section, and one cord through or along the bottom of each net course or section. In this exemplary embodiment, the cords carry a majority of the tension such that the nets may be fully stretched out without being tightly tensioned. This allows the nets to carry less tension, for example, than if the nets were pulled or tensioned purely from each of their respective four corners and only from the sides. While the nets are fully tensioned or pulled out, the nets are also being hung or suspended from the tethers (e.g., FIGS. 1 and 2, etc.) attached to each of the top cords of the first and second arrays. The bottom cords are stretched horizontally and tend to stretch the nets from top to bottom. This, in combination with the tethers connected to and suspending the top cords and tops of each net section or course, enables the nets to be less tensioned and "softer," and without being as inclined or prone to tangling or one net being pulled out of their proper alignment (and relative positions) and overlapping arrangement. This softness of the nets helps to improve performance of the apparatus as more taut nets might tend to act more like trampolines and absorb less energy and impart less drag of friction on the balls when impacting the array. Generally, looser or softer nets tend to pull and dissipate energy to surrounding net areas and thus are better at slowing and funneling the balls into and through gaps in the array and down to the court surface as disclosed herein.

The less taut adapter nets also impart less stress and true tension on the adapter nets, which, in turn, enables the adapter nets to be less prone to wear and tear. The adapter nets may thus be constructed of thinner net material and yet still be durable, thus enabling the array (e.g., even with 4 or more layers overlapping when installed including both arrays, etc.) to provide sufficient visibility through the net for players to sight the tennis ball and not obstruct viewing through the tennis net during play.

In exemplary embodiments, the top cord in each array may preferably be more taut than the lower cord such that the top of each array is more taut than the rest of the netting (or mesh, open meshwork, etc.) in the array. This may be accomplished in an exemplary embodiment by leaving some slack or space between the bottom corners of each net and the end posts. On average, tennis balls will generally hit the array relatively near the top of a single net in the array, and the impact will tend to deflect the ball more downward where it will pass behind the next lower net in the array. The ball will then travel to the court surface via the space between the array and the main tennis net. Advantageously, the lower tension of the nets may also allow the nets to more efficiently slow and redirect tennis balls.

Generally, the first and second adapter net arrays are configured to permit a tennis ball hit into the array (or into a portion of the main tennis net, e.g., above the array) to either contact the main tennis net directly or indirectly as the corresponding array net is pushed back into the main tennis net by the impact and momentum of the tennis ball. Upon impacting or hitting one or more of the array nets and/or the main tennis net, the tennis ball is generally slowed and/or deflected. The tennis ball loses speed as it is caught behind one of the arrays. Then, the ball funnels or drops down between the main net and the array eventually coming to rest on the court, with most balls nearer to the net.

Exemplary embodiments disclosed herein may be configured to have or provide one or more (but not necessarily any or all) of the following functions including preventing balls from bouncing off the net, rebounding, and/or rolling back onto the court; and/or enabling easier ball pickup or cleanup by ensuring that a high percentage of the balls hit into the net collect in the area on the court very close to the main tennis net.

As disclosed herein, the lowest net in an array may be set so that it tends to more regularly trap the balls on the court surface between the lowest net in the array and the main tennis net. In an exemplary embodiment, this may be accomplished through adjustment features built into the tethers (e.g., three tethers shown in FIG. 1, etc.), and the means by which they connect (e.g., looped about, etc.) to the top cord (and net) of the bottom net in each array. By way of example, the adjustment feature may comprise a cord lock (e.g., cord lock tensioners in FIG. 1, etc.), which may also be referred to as a lace lock or pinch lock. The cord lock allows the lower net to be set to provide for varying types of performance or function (e.g., varying heights shown in FIGS. 5 through 7, etc.). The cord lock also allows for a very simple and quick adjustment of the lower net to accommodate tennis nets that are higher or lower than regulation. Alternative embodiments may include other means for adjusting the bottom net (or bottom layer of netting or meshwork), e.g., to change the distance separating the court surface and bottom net. For example, other exemplary embodiments may include cinches for securing the adapter nets to the main tennis net, means for installing tethers below the tennis net tape (or net cord), markings for measuring net height, among other elements that might be included in exemplary embodiments.

Figure 2:
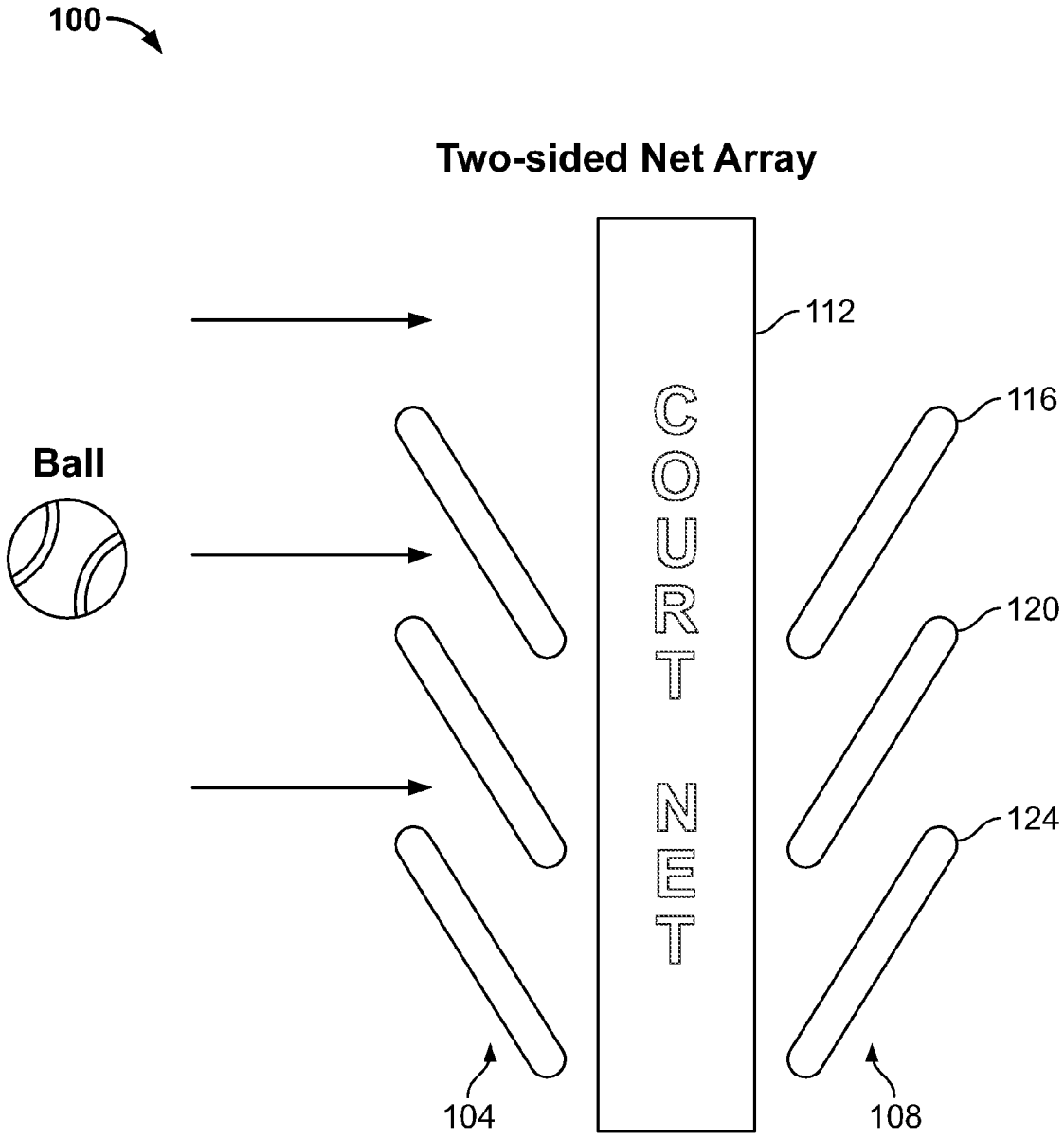
FIG. 2 illustrates a tennis net apparatus according to another exemplary embodiment, and showing the nets of the first and second arrays in an overlapping configuration.

With reference now to the figures, FIGS. 1 and 2 illustrates exemplary embodiments of a tennis net apparatus 100 embodying one or more aspects of the present disclosure. As shown in FIG. 1, the apparatus 100 includes first and second net arrays 104, 108 that are positionable on or along opposite first and second sides of a tennis net 112. Each net array 104, 108 includes three nets 116, 120, 124 (e.g., first, second, and third panels or layers of standard tennis netting, meshwork, open meshwork, etc.). The first net array 104 is coupled to, supported by, or suspended between a first pair of end posts 152, 160. The second net array 108 is coupled to, supported by, or suspended between a second pair of end posts 153, 161.

In FIG. 1, the individual nets 116, 120, 124 are spaced apart from each other in a non-overlapping configuration in some exemplary embodiments. In other exemplary embodiments, the nets 116, 120, 124 are in an overlapping configuration. For example, FIG. 2 illustrates an overlapping configuration in which an upper portion (e.g., upper edge or upper cord, etc.) of the middle net 120 overlaps a lower portion of the top net 116, and such that an upper portion (e.g., upper edge or upper cord, etc.) of the bottom net 124 overlaps a lower portion of the middle net 120.

FIG. 1 also illustrates an exemplary set of three tethers 128 including cord lock tensioners or cinch locks 132, anchor locks 136, positioning knots 140, loops 144, etc. as shown. The tennis net apparatus 100 includes two tightening or adjustment straps 148 attached to the first and second end posts 152, 153 at one end of the apparatus 100. At the opposite end, the tennis net apparatus 100 includes fixed cords 156 attached to the third and fourth end posts 160, 161. The straps 148 and cords 156 are used to secure the respective end posts 152, 160 to the tennis net posts. For example, the straps 148 and cords 156 may be positioned or wrapped at least partially around the tennis net posts. The straps 148 and cords 156 along with the tethers 128 maintain the height and vertical positioning of each of the nets 116, 120, 124 of the first and second arrays 104, 108 relative to each other and to the tennis net 112. In this example, the straps 148 allow the apparatus 100 to be tightened at the one end, which advantageously may make it less likely for the end posts 152, 153, 160, 161 to be misaligned and/or allow the apparatus 100 to be installed more easily and quicker.

The top cord in each array 104, 108 is preferably more taut than the bottom cord, such that each array 104, 108 is more taut at its top than the rest of the netting in the array. This may be accomplished in this exemplary embodiment by attaching the bottom cord to the end posts such that there is some slack or space between the bottom corners of each net and the end posts, thus resulting in the bottom of the net not being stretched as taut as the top of the net. This permits the net arrays 104, 108 to remain more slack and reduce the risk of tangling of the nets 116, 120, 124 caused by tennis ball or racket impacts or high winds. The lower cords combined with the overlapping net configuration helps prevent the bottom of one net from stretching up and tangling in the top of the net immediately therebelow. A single net may also roll up on itself around a tennis ball in some embodiments.

The lower net 124 in each array 104, 108 may be configured (e.g., with a cut shape, etc.) such that the center is approximately 6 inches shorter or narrower than the sides or ends. Accordingly, this mirrors or is similarly shaped to the taper of the main tennis net.

Figure 3:
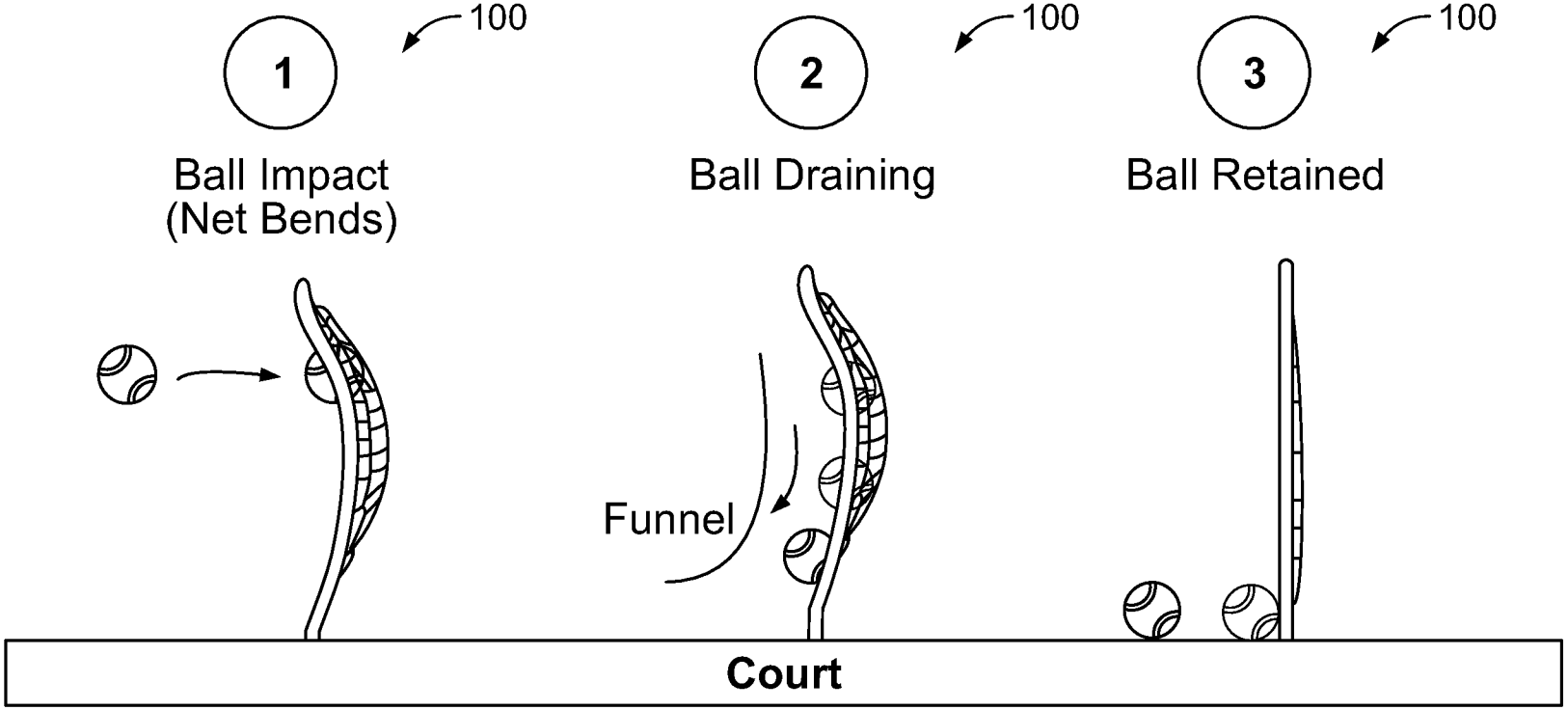
FIG. 3 illustrates the exemplary manner by which a tennis net apparatus operates to retain tennis balls at or close to the tennis net according to exemplary embodiments.

FIG. 3 illustrates the exemplary manner by which the tennis net apparatus 100 may retain a tennis ball at or close to the base of the tennis net. As shown, a tennis ball may hit one of the adapter nets of the apparatus 100 or hit the tennis net above the top net. The ball's impact force deforms or bends the tennis net to create a gap between the otherwise flush adapter net against the main tennis net. The tennis ball travel path is shown in sequence, though the tennis ball might also bounce off the back side of an adapter net and/or deflect off the main tennis net one or more times before funneling down onto the court as shown.

FIG. 4 shows an exemplary locking cinch device 164 that may be used to attach a tether 128 to the main tennis net 112. The cinching device 164 may be used to securely attach the tether 128 to the main tennis net 112 and also to help keep the tennis apparatus 100 centered and in place. The cinching device 164 may be quick to install and remove.

FIG. 5 generally shows the exemplary manner by which the cord lock tensioners or cinch locks 132 may be used to adjust the height of the tennis net adapter 100. For example, FIG. 6 shows the tennis net apparatus 100 setup about 2 to 2.5 inches off or above the court surface. In this setup, the tennis net apparatus 100 may retain the tennis balls about 1 to 3 feet from the tennis net 112, which may be ideal for coaching, cardio tennis, ball machines, etc. FIG. 7 shows the tennis net apparatus 100 in a different setup about 1 to 1.5 inches off or above the court surface. In this different setup, the tennis net apparatus 100 may retain or trap a majority of or most tennis balls at the base of the tennis net 112, which may be ideal for match play, etc.

Accordingly, exemplary embodiments are disclosed of tennis net adapters or apparatus comprising at least one array of overlapping smaller nets that may be generally stretched the width of a main tennis net and cover a majority of the net. The tennis net adapter or apparatus may be nearly fully flat or flush against the tennis net when at rest or until impacted by a tennis ball.

In an exemplary embodiment, first and second arrays of mostly horizontally stretched nets are configured to prevent tennis balls from bouncing off the net and back into the main play area to avoid balls being stepped on by players or otherwise interfere with play (e.g., being hit by a ball in play, etc.). The tennis net adapter or apparatus may enable faster and easier cleanup when the court is being used for training, drills, or lessons where there are usually a larger number balls on the court to be collected. In such circumstances, the balls can be collected (by hand or with mechanical ball collectors) easier and faster because with the tennis net adapter or apparatus the balls are more concentrated in a smaller space.

In operation, the tennis net adapter or apparatus will slow a ball that hits the net (or hits above, below or on the added nets of the adapter) and deflect the ball to the space created between the adapter and the main tennis net. Ultimately, the ball will be funneled and come to rest on the court in closer proximity to the net (e.g., within 3 feet or less, etc.). The nets of the tennis net adapter or apparatus in conjunction with the tennis net essentially form a functional funnel when in operation and struck by a tennis ball, whereby balls struck above or anywhere on the nets enter the funnel formed by the nets and main the tennis net and are slowed by the main tennis net and/or one or more of the nets of the first and second arrays.

In exemplary embodiments, the tennis net adapter or apparatus may include first and second arrays where each array includes two or more (e.g., 2, 3, 4, etc.) interconnected nets. The nets may be largely parallel to one another and overlapping to some degree to prevent balls traveling in the space behind the array (against the tennis net) from escaping out from one of the seams or junctions in the array formed where two nets meet. The seams or junctions where the nets overlap permit balls hit into the array to impact the array, slow down, be generally directed downward to some degree to be trapped in the space between the array and the tennis net, and eventually coming to rest on the court as disclosed herein.

As disclosed herein, exemplary embodiments of a tennis net adapter or apparatus are operable for slowing, directing/funneling and, generally, controlling balls after being hit into a tennis net such that the balls do not bounce or roll across the majority of the court (or do so only in small numbers as a percentage of balls so hit). A ball will tend to be slowed more so in some exemplary embodiments of a tennis net adapter or apparatus because the tethers connecting the top cord on each of the nets of the arrays essentially join the nets such that when one net deflects, all the nets to some degree are pulled towards the main net. This dissipates significant kinetic energy into the array as a whole, and as the ball slows, it deflects even more so in a downward direction. Also, the top cord of each net in the array is taut in some exemplary embodiments. Thus when a ball strikes any net in the array, the netting in that net or course (and adjacent ones via the tethers) dissipate energy laterally as well as slack netting in the nets or courses is pulled in from the left and right side of where the ball impacts. So both the angle formed by the distended net in the array and through absorption of kinetic energy, balls hit into the array will slow and deflect significantly more so through the impact in such exemplary embodiments.

Balls hit into the main body of a net tend to deflect largely along their trajectory when coming into the net. Balls coming straight in (horizontally) tend to bounce back—though of course, still somewhat downward, as the ball loses speed and, in any case, accelerates downward due to gravity. Balls struck near the net cord rebound differently off the net compared to, for example, balls that hit and rebound from other lower areas of the net. This is because the net cord tends to anchor that portion of the net so when a ball strikes the net cord or thereabout it creates a more downward angled area of the net (as the ball pushes the net back more in the area below the point of impact versus for the net area above the point of impact stabilized by the tighter net cord). In exemplary embodiments, the tennis net adapter or apparatus does not cover the area of the tennis net just below the net cord because balls hitting the net in this area generally impact the tennis net and deflect downward behind the tennis net adapter (and in some cases, nearly more directly downward significantly impacting the net-side of the array). In some cases where the balls strike the net cord and deflects, the balls may lose very little speed and angle sharply downward. Thus, with the tennis net adapter installed, the speed of the ball is reduced by impacting the net and array below the initial ball impact point, and more fully when impacting the court surface and possibly bouncing back into the array, before coming to rest on the court.

For balls impacting one or more of the nets of an array, a similar phenomenon occurs though the motion of the ball as it interacts with both the main tennis net and the net adapter array might be more complex, despite a similar result. Specifically, the angle formed by the main tennis net when a ball strikes on or near the net cord occurs to some degree on each course when the ball strikes any single net of a net adapter array. The top strand or cord in each net in the array is preferably the heaviest and tightest cord (the top cord may be the primary tensioning mechanism for each net). When a ball strikes one of the adapter's nets, the top cord will tend to deflect less so than the lower portion of the net. Thus, the net struck by the ball will tend to both slow and deflect the ball more so than when striking the main tennis net alone—causing the ball to generally deflect or bounce back on a lower trajectory and with less energy, such that the ball is more likely to be caught behind the next lower net in the array before funneling ultimately to the court surface.

Thus, while the net adapter array absorbs some of the ball's kinetic energy, the array of nets causes balls hit into the array to generally be deflected more downwards. With the multiple nets or courses, it doesn't matter which net in the array is hit as the ball will inevitable hit closer to a tighter top cord (or a single net in the array), which will tend to impact the net shape in a similar way as when balls are hit near the top of the main net cord. Thus, reducing their speed and also forming an angle to deflect balls more downward versus mostly back in the direction the ball was hit from. The combination of tighter top cords with non-tensioned or looser remaining net portions assists in this.

Also, the overall energy absorption of the tennis net adapter arrays further improves the adapter's ability to capture balls hit into the array as the speed of the ball declines after impacting and deforming the array. As the ball hits the array (which is also pushed into the main tennis net), the ball slows significantly causing the downward acceleration due to gravity to impart a greater downward component to the rebound trajectory. The tethers between the nets enhance this effect and energy absorption of the net adapter array by transferring energy and causing net motion to other adapter nets and creating greater overall movement in the nets of the array—in effect, absorbing kinetic energy in the process (even for balls that are not captured as intended by one of the nets in the array). This slows the ball significantly more than the main tennis net alone, where the movement and temporary shape deformation of the net is more localized. The main tennis net continues to absorb nearly as much energy as it did without the tennis net adapter or apparatus installed.

Regarding the tethers that connect the top nets of the net adapter array, the tethers might be aligned more or less vertically and spaced roughly evenly across the array. In some exemplary embodiments, there may be three sets of tethers, where each set includes three tethers possibly having a different length than the tethers in the other sets. One tether may be located at the center of the net and the other two roughly evenly spaced between the center of the net and the two ends of the tennis net (and adapter). The tethers generally keep the individual nets or courses of the arrays organized and positioned relative to each another. The tethers also help prevent the nets from sagging, which might otherwise cause gaps in the array or less uniform overlap between the adapter nets. The tethers may also help facilitate the array returning to its at rest shape more quickly after being deformed due to a ball impact. The tethers may also enable the at rest shape to be maintained with less tension, which increases the life and durability of the net adapter. This also avoids putting excess stress or pressure on the main tennis net posts that is naturally added by installing the adapter arrays, which added tension may be reduced by the tethers.

In exemplary embodiments, the lowest net in the adapter net array preferably does not contact the court surface, such that balls hit into the net and being deposited (or funneled) onto the court can be more easily picked up, including with mechanical tennis ball "sweepers." This might also have some variability to set the precise height off the court surface (e.g., ranging from 2 to 3 inches, etc.). To allow for this height adjustment, the net adapter end posts may be provided with one or more slots configured such that the top cords or lines do not slide vertically once set in position in the slot. For example, if the top cord of the bottom net were set in the top of the slot then the array might be 3 inches off the court surface. Or, for example, the array might be 2 inches off the court surface if the top cord of the bottom net is set in the lower end of the slot.

The width, height, and number of nets or courses in the net adapter array may vary. By way of example only, each net in the array might be between about 8 to 15 inches tall and about 36 to 41 feet wide so as to be generally shorter than the narrowest span of regulation tennis nets and posts. Continuing with this exemplary embodiment, the overlap of each net might be from 1 to 8 eight inches, and the total height of the assembled/installed net adapter array might be about 27 to 30 inches at the center tape line and about 33 to 36 inches on the outer sides (at or outside of the alleys of the doubles court).

The installation components, elements, and methods can vary in exemplary embodiments. The net adapter may be configured to be largely flat when installed and at rest (not impacted or recoiling from a ball impacting the net adapter array). In an exemplary embodiment, a tennis net adapter includes two tensioning or tightening devices located only at one end of the tennis net posts, such that installation and removal are relatively simple and convenient. Each tensioner may be configured to tighten two net cords, whereby the two nets may be connected and then tensioned simultaneously with a single cord and tensioner (e.g., requiring only one tensioner/fastener per two adapter nets, etc.).

The tennis net adapter end posts (e.g., four in total with two on each side of the net) may provide horizontal positioning for the top and bottom cords or strands for each net or course of the adapter arrays. In an exemplary embodiment, the top and bottom cords are connected to the adapter posts. The adapter's two straps and fixed cords are attached to the main tennis net posts. This provides a simplified installation (only two straps to tighten) and helps ensure that if the two opposing posts (two at each end of the net—one on each side of the net) are secured together they can more easily be aligned before being secured together and more or less anchored to the main tennis net (and more likely vertical and parallel to one another). In an exemplary embodiment, the top cord in each net of the net adapter might be heavier than rest of netting, reducing costs, weight, and reducing the obstruction of visibility that might occur with such extra layers of heavier gauge netting.

An exemplary process for installing (e.g., retrofitting to an existing tennis net, etc.) an exemplary embodiment of a tennis net adapter or apparatus will now be provided. The tennis net adapter is spread out (e.g., unrolled, etc.) on a tennis court adjacent and generally parallel to the main tennis net. The end posts are picked up, and the arrays of nets are stretched out. The end posts are separated and held vertically. The tennis adapter is positioned (e.g., lifted above and then lowered, etc.) relative to the main tennis net such that the first and second arrays of nets are on or along opposite sides of the tennis net and such that the straps and cords are around the tennis net poles. Then, the straps are sufficiently tightened to prevent sagging but not overly tightened, such that the first and second arrays of nets generally follow the natural line of the main tennis net. Tethers and cord lock tensioners may be used to secure the first and second arrays of nets to the main tennis net and to adjust their height. Alternative embodiments may include other means for securing the first and second arrays of nets to the main tennis net and for adjusting the configuration (e.g., height, tension, etc.) of the first and second arrays of nets.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An apparatus comprising:

a first pair of end posts;

a second pair of end posts;

a first array of nets supported between the first pair of end posts;

a second array of nets supported between the second pair of end posts; and the first and second arrays are positionable along respective opposite first and second sides of a tennis net when the first and second pairs of end posts are coupled to posts of the tennis net;

whereby the apparatus is configured such that when the apparatus is installed on the tennis net:

a tennis ball hit into the first side of the tennis net above the first array or hit into a net of the first array other than a bottommost net of the first array will pass the first array to be funneled behind the first array and against the first side of the tennis net such that the tennis ball will slow down and come to rest at or adjacent a bottom of the first side of the tennis net; and a tennis ball hit into the second side of the tennis net above the second array or hit into a net of the second array other than a bottommost net of the second array will pass the second array to be funneled behind the second array and against the second side of the tennis net such that the tennis ball will slow down and come to rest at or adjacent a bottom of the first side of the tennis net.

2. The apparatus of claim 1, wherein each of the first and second arrays comprises a vertical array of two or more nets that are spaced apart from each other, generally parallel, and with at least a portion of one net overlapping at least a portion of another net.

3. The apparatus of claim 1, wherein:

each of the first and second arrays includes a top net, a bottom net, and a middle net between the top and bottom nets;

the top, middle, and bottom nets are spaced apart from each other;

an upper portion of the middle net overlaps a lower portion of the top net; and an upper portion of the bottom net overlaps a lower portion of the middle net.

4. The apparatus of claim 1, wherein:

the first array of nets includes a plurality of nets having an overlapping configuration;

the second array of nets includes a plurality of nets having an overlapping configuration;

whereby a tennis ball striking a net will cause the net to move and open a gap between the net and an adjacent net thereby allowing the tennis ball to pass through the gap into a space between the corresponding first or second array and the tennis net.

5. The apparatus of claim 1, further comprising an attachment system for attaching the first and second pairs of end posts to the posts of the tennis net, wherein the attachment system is configured to allow selectively tightening and tensioning of the first and second arrays of nets.

6. The apparatus of claim 5, wherein the attachment system comprises:

one or more fixed length cords at one end of the apparatus for attaching the apparatus to one of the posts of the tennis net; and one or more adjustable length straps at the opposite end of the apparatus for attaching the apparatus to the other one of the posts of the tennis net;

whereby the first and second arrays of nets may be selectively tightened and tensioned via the one or more adjustable length straps at the opposite end.

7. The apparatus of claim 1, further comprising one or more tethers configured to be coupled to each said net of the first and second arrays to help support and maintain position of the nets relative to each other and to the tennis net.

8. The apparatus of claim 7, wherein:

the one or more tethers comprise first, second, and third tethers, the first tether configured to be respectively located at about a center of the apparatus, and the second and third tethers configured to be located on opposite sides of the first tether between the center and respective opposite ends the apparatus; and means for adjusting an effective length of the tethers.

9. The apparatus of claim 7, further comprising:

one or more cord lock tensioners to attach the one or more tethers to the tennis net; and one or more cord lock tensioners to adjust a height of the apparatus.

10. The apparatus of claim 1, further comprising one or more tethers configured to be connected to a top cord of each said net, whereby when one net is deflected by a tennis ball the other nets in the same first or second array are at least partially deflected such that kinetic energy may be dissipated by the array of nets as a whole.

11. The apparatus of claim 1, further comprising means for selectively adjusting a distance separating a bottommost net of the first and second arrays from a tennis court surface including at least:

a first distance in which tennis balls exiting from the bottom of the corresponding first or second array will remain close to the tennis net; and a second distance in which tennis balls exiting from the bottom of the corresponding first or second array will be trapped or funneled generally between a base of the tennis net and a bottom of the corresponding first or second array.

12. The apparatus of claim 1, wherein:

each said net of the first array includes a top cord and a bottom cord that are attached to the first pair of end posts; and each said net of the second array includes a top cord and a bottom cord that are attached to the second pair of end posts.

13. The apparatus of claim 12, wherein:

the top and bottom cords carry a majority of the tension of each said net thereby allowing the net to be fully stretched out and less taut with less tension in the net; and/or the top cord is more taut than the bottom cord in each said net, such that the top cord is a primary tensioning mechanism for the net.

14. The apparatus of claim 1, wherein:

the first array includes three or more nets; and the second array includes three or more nets.

15. The apparatus of claim 1, wherein the first and second arrays of nets are configured to be substantially flat and flush against the tennis net and substantially cover the entire tennis net surface when the apparatus is installed onto the tennis net.

16. The apparatus of claim 1, wherein a top net of the first and second arrays is configured to be spaced apart below a top cord of the tennis net, to thereby allow a tennis ball passing above the first array to hit a top portion of the first side of the tennis net before the tennis ball is funneled downwardly between the first array and the first side of the tennis net; and to thereby allow a tennis ball passing above the second array to hit a top portion of the second side of the tennis net before the tennis ball is funneled downwardly between the second array and the second side of the tennis net.

17. The apparatus of claim 1, wherein at least a bottom net of the first and second arrays has an hourglass shape that is narrowest at its center.

18. A tennis net adapter comprising:

a first pair of end posts;

a second pair of end posts;

a first array of nets in an overlapping configuration such that at least a portion of one net overlaps at least a portion of another net of the first array, the first array of nets supported between the first pair of end posts;

a second array of nets in an overlapping configuration such that at least a portion of one net overlaps at least a portion of another net of the second array, the second array of nets supported between the second pair of end posts; and one or more tethers configured to be coupled to each said net of the first and second arrays to help support and maintain position of the nets relative to each other and to the tennis net;

wherein the first and second arrays of nets are positionable alongside respective opposite first and second sides of a tennis net when the first and second pairs of end posts are coupled to posts of the tennis net.

19. The tennis net adapter of claim 18, further comprising an attachment system for attaching the first and second pairs of end posts to the posts of the tennis net; and wherein:

the attachment system is configured to allow selectively tightening and tensioning of the first and second arrays of nets;

each of the first and second arrays includes a top net, a bottom net, and a middle net between the top and bottom nets;

the top, middle, and bottom nets are spaced apart from each other;

an upper portion of the middle net overlaps a lower portion of the top net;

an upper portion of the bottom net overlaps a lower portion of the middle net;

each said net of the first array includes a top cord and a bottom cord that are attached to the first pair of end posts;

each said net of the second array includes a top cord and a bottom cord that are attached to the second pair of end posts; and the one or more tethers are configured to be connected to a top cord of each said net, such that when one net is deflected by a tennis ball the other nets in the same first or second array are at least partially deflected.

20. In combination with a tennis net supported between posts, an apparatus comprising:

a first pair of end posts;

a second pair of end posts;

a first array of nets in an overlapping configuration such that at least a portion of one net overlaps at least a portion of another net of the first array, each said net of the first array includes a top cord and a bottom cord that are attached to the first pair of end posts such that the first array of nets is supported between the first pair of end posts;

a second array of nets in an overlapping configuration such that at least a portion of one net overlaps at least a portion of another net of the second array, each said net of the second array includes a top cord and a bottom cord that are attached to the second pair of end posts such that the second array of nets is supported between the second pair of end posts; and an attachment system for attaching the first and second pairs of end posts to the posts of the tennis net, the attachment system configured to allow selectively tightening and tensioning of the first and second arrays of nets; and one or more tethers coupled to each said net of the first and second arrays to help support and maintain position of the nets relative to each other and to the tennis net, whereby when one net is deflected by a tennis ball the other nets in the same first or second array are at least partially deflected;

wherein the first and second arrays of nets are positionable alongside the respective first and second sides of a tennis net when the first and second pairs of end posts are coupled to posts of the tennis net.

* * * * *